US011401900B2

(12) United States Patent
Honnikoppa et al.

(10) Patent No.: US 11,401,900 B2
(45) Date of Patent: Aug. 2, 2022

(54) FUEL PROTECTION APPARATUS AND RELATED SYSTEMS FOR USE WITH VEHICLES

(71) Applicant: TOYOTA MOTOR ENGINEERING & MANUFACTURING NORTH AMERICA, INC., Plano, TX (US)

(72) Inventors: Shashikumar Honnikoppa, Ann Arbor, MI (US); Samuel D. Koch, Ann Arbor, MI (US); Adam J. Davis, Ypsilanti, MI (US); Mark Clauser, Saline, MI (US); Andrew F. Stewart, Northville, MI (US)

(73) Assignee: TOYOTA MOTOR ENGINEERING & MANUFACTURING NORTH AMERICA, INC., Plano, TX (US)

( * ) Notice: Subject to any disclaimer, the term of this patent is extended or adjusted under 35 U.S.C. 154(b) by 251 days.

(21) Appl. No.: 16/784,669

(22) Filed: Feb. 7, 2020

(65) Prior Publication Data

US 2021/0246857 A1 Aug. 12, 2021

(51) Int. Cl.
*F02M 37/00* (2006.01)

(52) U.S. Cl.
CPC ..... *F02M 37/0017* (2013.01)

(58) Field of Classification Search
CPC ..... F02M 37/0017; F02M 39/02; F02M 2200/185
See application file for complete search history.

(56) References Cited

U.S. PATENT DOCUMENTS

| | | | | |
|---|---|---|---|---|
| 7,063,074 | B2 | 6/2006 | Horibe et al. | |
| 10,294,904 | B2 | 5/2019 | Tanaka et al. | |
| 10,473,069 | B2 | 11/2019 | Sasaki | |
| 2007/0012501 | A1 | 1/2007 | Frank et al. | |
| 2015/0337784 | A1* | 11/2015 | Ishikawa | F02M 37/06 123/198 E |
| 2019/0331078 | A1 | 10/2019 | Kato et al. | |
| 2019/0337378 | A1 | 11/2019 | Spurling et al. | |

FOREIGN PATENT DOCUMENTS

| | | | | |
|---|---|---|---|---|
| EP | 1441122 | A1 * | 7/2004 | F02M 35/10288 |
| EP | 1447553 | A2 * | 8/2004 | F02M 35/10078 |
| JP | 2004360581 | A * | 12/2004 | F02M 39/02 |
| JP | 2007016716 | A * | 1/2007 | F02M 39/02 |
| JP | 2007138847 | A * | 6/2007 | F02M 59/48 |
| JP | 6369391 | B2 | 8/2018 | |

* cited by examiner

*Primary Examiner* — Hung Q Nguyen
(74) *Attorney, Agent, or Firm* — Oblon, McClelland, Maier & Neustadt, L.L.P.

(57) ABSTRACT

Fuel protection apparatus and related systems for use with vehicles are disclosed. A disclosed vehicle includes a fuel component in an engine compartment of the vehicle. The vehicle also includes a spacer coupled to a cam carrier and positioned proximate to the fuel component. The vehicle also includes a protector coupled to a cylinder head and spaced from the spacer and the cam carrier. The protector is configured to receive a load from a cowl brace or firewall of the vehicle during a vehicle impact event in which an engine assembly of the vehicle moves relative to the cowl brace or firewall. The protector is configured to transfer the load to the cylinder head, the cam carrier, and the spacer to protect the fuel component.

20 Claims, 7 Drawing Sheets

FUEL PROTECTION APPARATUS AND RELATED SYSTEMS FOR USE WITH VEHICLES

FIELD OF THE DISCLOSURE

This disclosure relates generally to vehicles and, more particularly, to fuel protection apparatus and related systems for use with vehicles.

BACKGROUND

Motor vehicles typically employ fuel protection systems that improve vehicle safety by providing protection to fuel components in an engine compartment of a vehicle during certain impact conditions. Often, automotive manufactures perform controlled crash tests to ensure vehicle components properly deform in a manner that would keep occupants of a vehicle safe in a real-world collision.

SUMMARY

An example vehicle includes a fuel component in an engine compartment of the vehicle. The vehicle also includes a spacer coupled to a cam carrier and positioned proximate to the fuel component. The vehicle also includes a protector coupled to a cylinder head and spaced from the spacer and the cam carrier. The protector is configured to receive a load from a cowl brace or firewall of the vehicle during a vehicle impact event in which an engine assembly of the vehicle moves relative to the cowl brace or firewall. The protector is configured to transfer the load to the cylinder head, the cam carrier, and the spacer to protect the fuel component.

An example fuel protection assembly for a vehicle includes a spacer coupled to a first engine component of the vehicle and positioned proximate to a fuel component of the vehicle. The fuel protection assembly also includes a protector coupled to a second engine component of the vehicle and spaced from the spacer and the first engine component. The protector is configured to receive a load from a vehicle structure in an engine compartment of the vehicle during a vehicle impact event. The protector is configured to transfer the load to the first engine component, the second engine component, and the spacer to protect the fuel component.

An example apparatus includes a protector in an engine compartment of a vehicle. The protector is coupled to a first engine component and interposed between a fuel component and a vehicle structure. The protector extends alongside a second engine component and a spacer that is proximate to the fuel component. The protector is changeable between (a) a first state in which the protector is spaced from the second engine component and the spacer and (b) a second state in which the protector is engaged with the second engine component and the spacer. In response to the vehicle structure applying a load to the protector during a vehicle impact event, the protector is configured to change from the first state to the second state to minimize a portion of the load transferred to the fuel component.

The foregoing paragraphs have been provided by way of general introduction, and are not intended to limit the scope of the following claims.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

In general, the same reference numbers will be used throughout the drawing(s) and accompanying written description to refer to the same or like parts.

DETAILED DESCRIPTION

Figure 1:
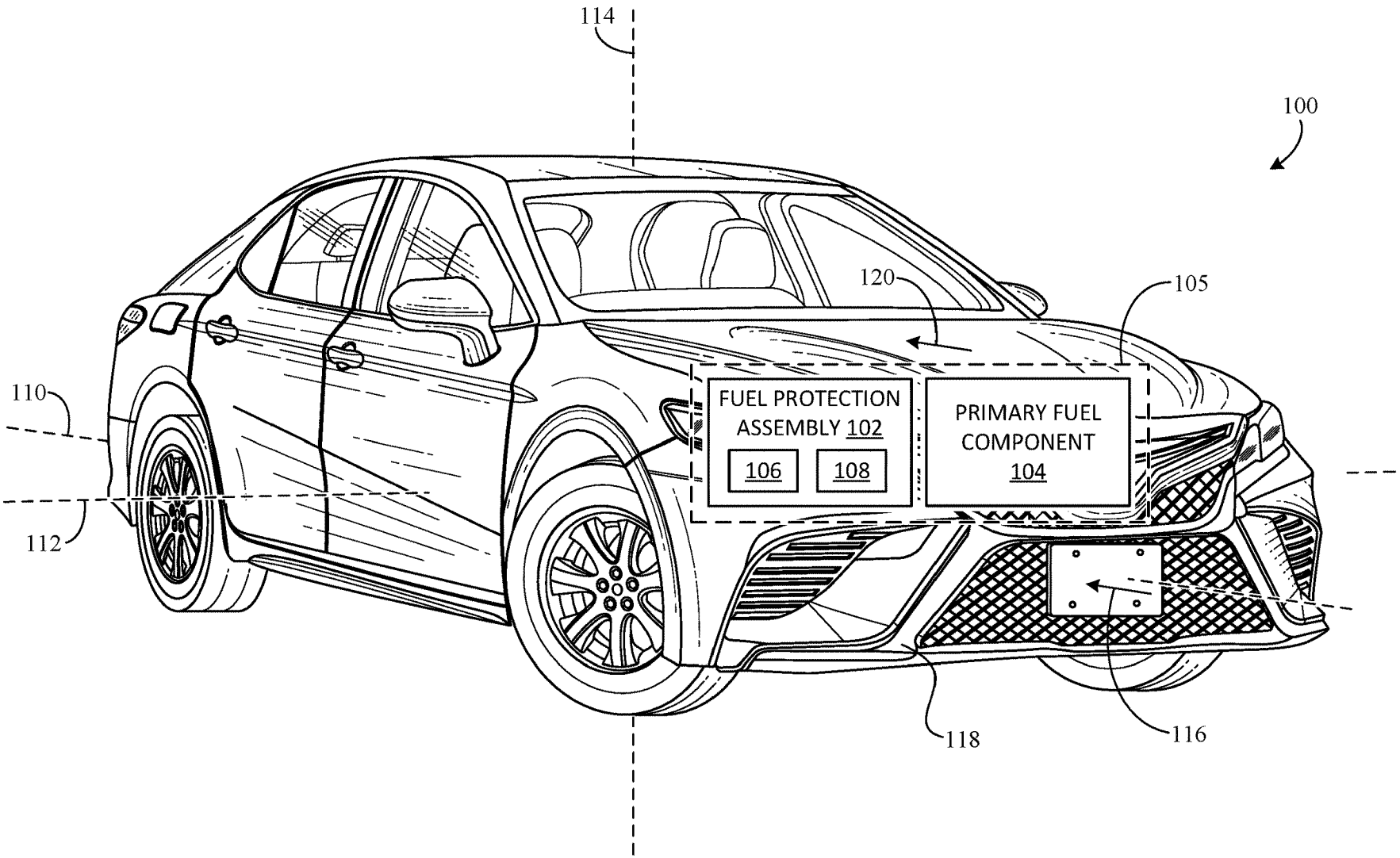
FIG. 1 is a view of an example vehicle in which examples disclosed herein can be implemented.

During certain impact conditions of a vehicle, an engine assembly can move relative to other parts of the vehicle, such as a firewall located rearward of the engine assembly. In some conditions, components of the engine assembly, including the fuel lines and fuel pump, could contact the firewall, which can damage the fuel lines and/or the fuel pump as well as cause fuel leaks. To improve vehicle safety in such conditions, some fuel protection systems include strong brackets that extend over and cover the fuel lines and fuel pump. These brackets are attached to the engine at two or more locations. The brackets can be configured to shield the fuel lines and fuel pump and transfer the forces to an engine component, such as an engine cylinder head. However, such brackets need to be large enough and thick enough so as not to deform to the point the fuel lines and fuel pump are contacted. As a result, such known brackets are expensive to produce and/or add substantial weight to a vehicle in which the brackets are installed.

Fuel protection apparatus and related systems for use with vehicles are disclosed. Examples disclosed herein provide a compact, cost-effective solution to protect one or more fuel components of a vehicle during a certain vehicle impact event in which an engine assembly of the vehicle moves relative to a structure (e.g., one of a firewall, a cowl brace, etc.) in an engine compartment of the vehicle. Some disclosed examples provide a fuel protection assembly for the vehicle including an example protector and an example spacer that are positioned on the engine assembly. The disclosed spacer is coupled to a first engine component (e.g., a cam carrier) and positioned proximate to at least one fuel component of interest such as, for example, a fuel pump, a fuel line routed near a portion of an engine, etc. The disclosed protector is coupled to a second engine component (e.g., a cylinder head) and spaced from the first engine component and the spacer. That is, prior to the vehicle impact event, gaps (e.g., relatively small gaps) exist between (a) the protector and the first engine component and (b) the protector and the spacer. The disclosed protector can be positioned between the fuel component and the structure, which allows the protector to shield the fuel component from the structure. During the vehicle impact event, the structure and the protector move toward and engage each other. As a result, the structure applies a certain load to the protector, which causes the protector to move and/or deform relative to an attachment point on the second engine component. In particular, the disclosed protector is configured to transfer the load to the first engine component, the second engine component, and the spacer to protect the fuel component, which will be discussed in greater detail below in connection with FIGS. 1-7.

In some examples, the disclosed protector is changeable between (a) a first state (e.g., an undeformed state) in which the protector is spaced from the first engine component and the spacer and (b) a second state (e.g., a deformed state) in which the protector is engaged with the first engine component and the spacer. In such examples, the protector is configured to the change from the first state to the second state if the load applied to the protector is above a threshold load. In this manner, the protector distributes the load to multiple locations on the engine assembly so as not to overcome a capacity of any one component. As a result, disclosed examples reduce or minimize the load by causing the engine components of the vehicle to effectively absorb the impact energy, which would have otherwise been transferred to the fuel component. In the final event, the protector applies a compressive load to the spacer but not a tensile load associated with causing damage to the fuel component. Additionally, the disclosed protector is substantially lighter compared to the above-mentioned known strong brackets and can be attached to one area of the engine assembly. Thus, disclosed examples improve vehicle safety while reducing vehicle weight.

FIG. 1 is a view of an example vehicle (e.g., a car, a truck, a van, a sport utility vehicle (SUV), etc.) 100 in which examples disclosed herein can be implemented. According to the illustrated example of FIG. 1, the vehicle 100 includes a fuel protection assembly 102 and a primary fuel component 104. The vehicle 100 of FIG. 1 also includes an engine assembly 105 (as represented by the dotted/dashed lines of FIG. 1) and an engine compartment 200 (shown in FIG. 2) in which the engine assembly 105 is disposed. The fuel protection assembly 102 and the primary fuel component 104 can be coupled to and/or supported by the engine assembly 105. The fuel protection assembly 102 of FIG. 1 includes a protector 106 and a spacer 108, which will be discussed in greater detail below in connection with FIGS. 2-7. In particular, the protector 106 and the spacer 108, together, are configured to provide protection to the primary fuel component 104 during a vehicle impact event in which the engine assembly 105 displaces or moves relative to one or more nearby vehicle structures (e.g., any of a fire wall, a brace, etc.) in the engine compartment 200. Additionally, in some examples, the protector 106 and the spacer 108, together, are configured to similarly provide protection to multiple fuel components of the vehicle 100, including the primary fuel component 104 of FIG. 1, during the vehicle impact event. The vehicle impact event can include, for example, a vehicle crash test such as a frontal crash test.

As shown in FIG. 1, the vehicle 100 is associated with a first axis (e.g., an x-axis) 110, a second axis (e.g., a y-axis) 112, and a third axis (e.g., a z-axis) 114 that are perpendicular to each other. The first axis 110 of FIG. 1 is a longitudinal axis associated with the vehicle 100, which is sometimes referred to as a roll axis. The second axis 112 of FIG. 1 is a lateral axis associated with the vehicle 100, which is sometimes referred to as a transverse or pitch axis. The third axis 114 of FIG. 1 is a vertical axis associated with the vehicle 100, which is sometimes referred to as a yaw axis. When the vehicle impact event occurs, an external structure (e.g., a substantially rigid barrier) can impart a relatively large load 116 on a frontal portion 118 of the vehicle 100 in response to the vehicle 100 and the external structure colliding. Such a collision can cause the engine assembly 105 and, consequently, the fuel protection assembly 102 and the primary fuel component 104 to move relative to the vehicle 100 in a first direction (e.g., a rearward direction substantially perpendicular to the first axis 110) 120.

Figure 2:
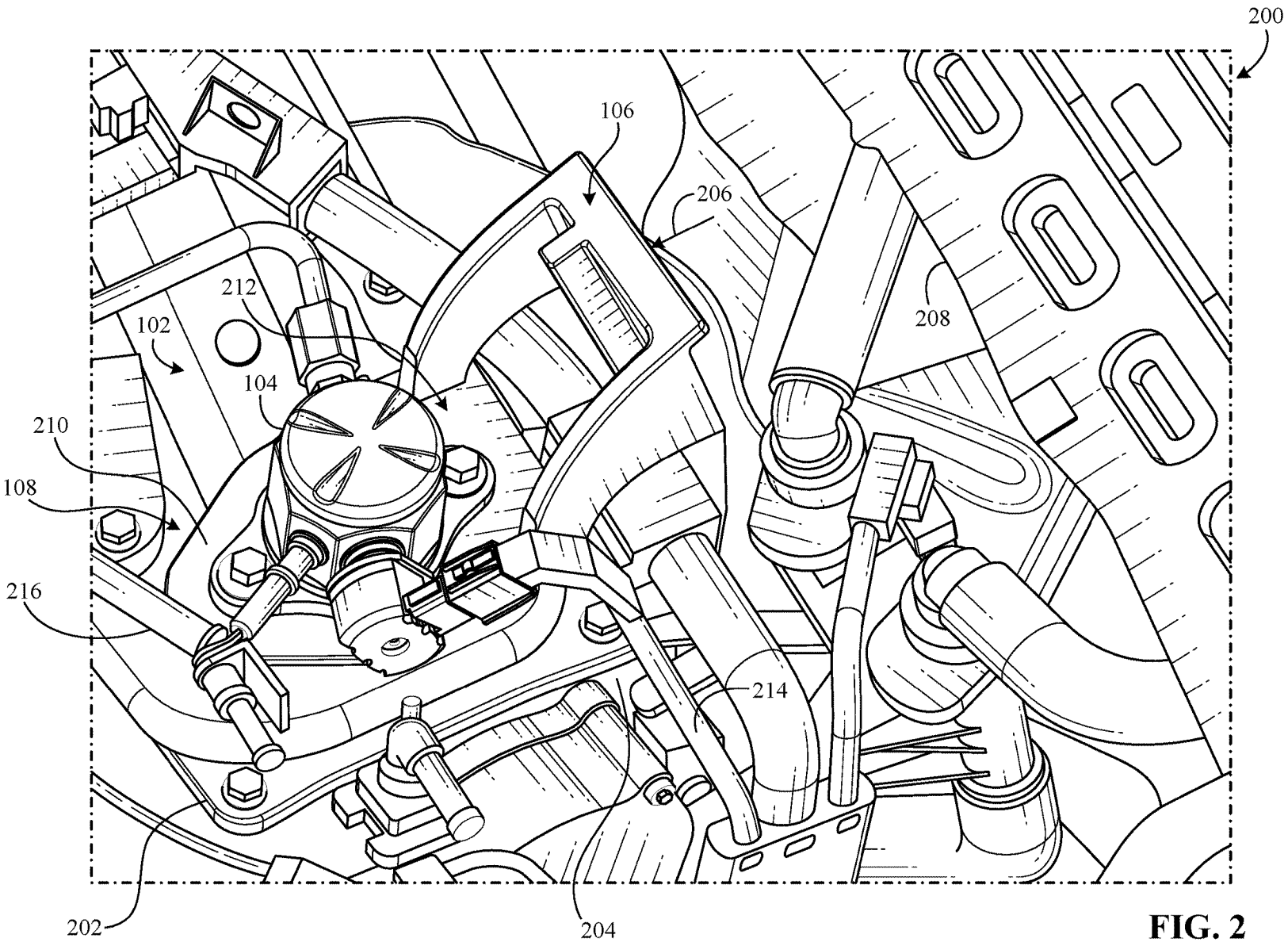
FIG. 2 is a view of an engine compartment of the vehicle of FIG. 1 and shows an implementation of an example fuel protection assembly in accordance with the teachings of this disclosure.

FIG. 2 is a view of the engine compartment 200 of the vehicle 100 of FIG. 1 and shows an implementation of the fuel protection assembly 102 in accordance with the teachings of this disclosure. According to the illustrated example of FIG. 2, each of the primary fuel component 104, the protector 106, and the spacer 108 is in the engine compartment 200 of the vehicle 100. The spacer 108 of FIG. 2 is coupled to a first engine component (e.g., a cam carrier) 202 of the vehicle 100. Additionally, the spacer 108 of FIG. 2 is positioned adjacent or proximate to the primary fuel component 104. That is, the spacer 108 is positioned within a relatively short distance from the primary fuel component 104. Further, the protector 106 of FIG. 2 is coupled to a second engine component (e.g., a cylinder head) 204 of the vehicle 100. The protector 106 is spaced from the spacer 108 and the first engine component 202, which will be discussed in greater detail below in connection with FIG. 3. In particular, the protector 106 is configured to receive a primary load 206 from a structure (e.g., one of a firewall, a cowl brace, etc.) 208 of the vehicle during the vehicle impact event. That is, the structure 208 and the protector 106 can move toward each other during the vehicle impact event. More particularly, as the structure 208 engages the protector 106, the protector 106 is configured to the transfer the primary load 206 to the first engine component 202, the second engine component 204, and the spacer 108 to protect the primary fuel component 104. The structure 208 of FIG. 2 is sometimes referred to as a vehicle structure and/or an impact structure. As shown in FIG. 2, the structure 208 can be a brace (e.g., a cowl brace). In some examples, the structure 208 of FIG. 2 includes the brace or the firewall. However, in some examples, the structure 208 of FIG. 2 can include or correspond to a different component of the vehicle 100.

The spacer 108 of FIG. 2 includes a body (e.g., a plate) 210. As shown in FIG. 2, the body 210 of the spacer 108 is arranged along an outer surface of the first engine component 202. The body 210 and/or, more generally, the spacer 108 can be constructed of one or more materials having suitable material properties such as, for example, any of steel, aluminum, cast iron, etc., any other suitable material(s), or a combination thereof. In particular, the body 210 includes a receiving portion 212 extending away from the primary fuel component 104 toward the protector 106, which provides a surface for receiving part of the protector 106 during the vehicle impact event. In some examples, the primary fuel component 104 includes a fuel pump, as shown in FIG. 2. In such examples, the body 210 of the spacer 108 is coupled between the primary fuel component 104 and the first engine component 202.

In some examples, the first engine component 202 of FIG. 2 includes a cam carrier of an engine. Further, in some examples, the second engine component of FIG. 2 includes a cylinder head of the engine. In such examples, the first engine component 202 is coupled to the second engine component 204, for example, via one or more fasteners and/or one or more fastening methods or techniques. However, in some examples, the first engine component 202 and/or the second engine component 204 can be implemented differently.

As shown in FIG. 2, the vehicle 100 can include one or more auxiliary fuel components (e.g., fuel lines) 214, 216 routed near the fuel protection assembly 102, two of which are shown in this example. That is, in some examples, the vehicle 100 includes a first auxiliary fuel component (e.g., a fuel line) 214 and a second auxiliary fuel component (e.g., a fuel line) 216. The auxiliary fuel component(s) 214, 216 can facilitate conveying fuel to and/or away from the primary fuel component 104. In particular, each of the auxiliary fuel component(s) 214, 216 is fluidly coupled to the primary fuel component 104.

Figure 3:
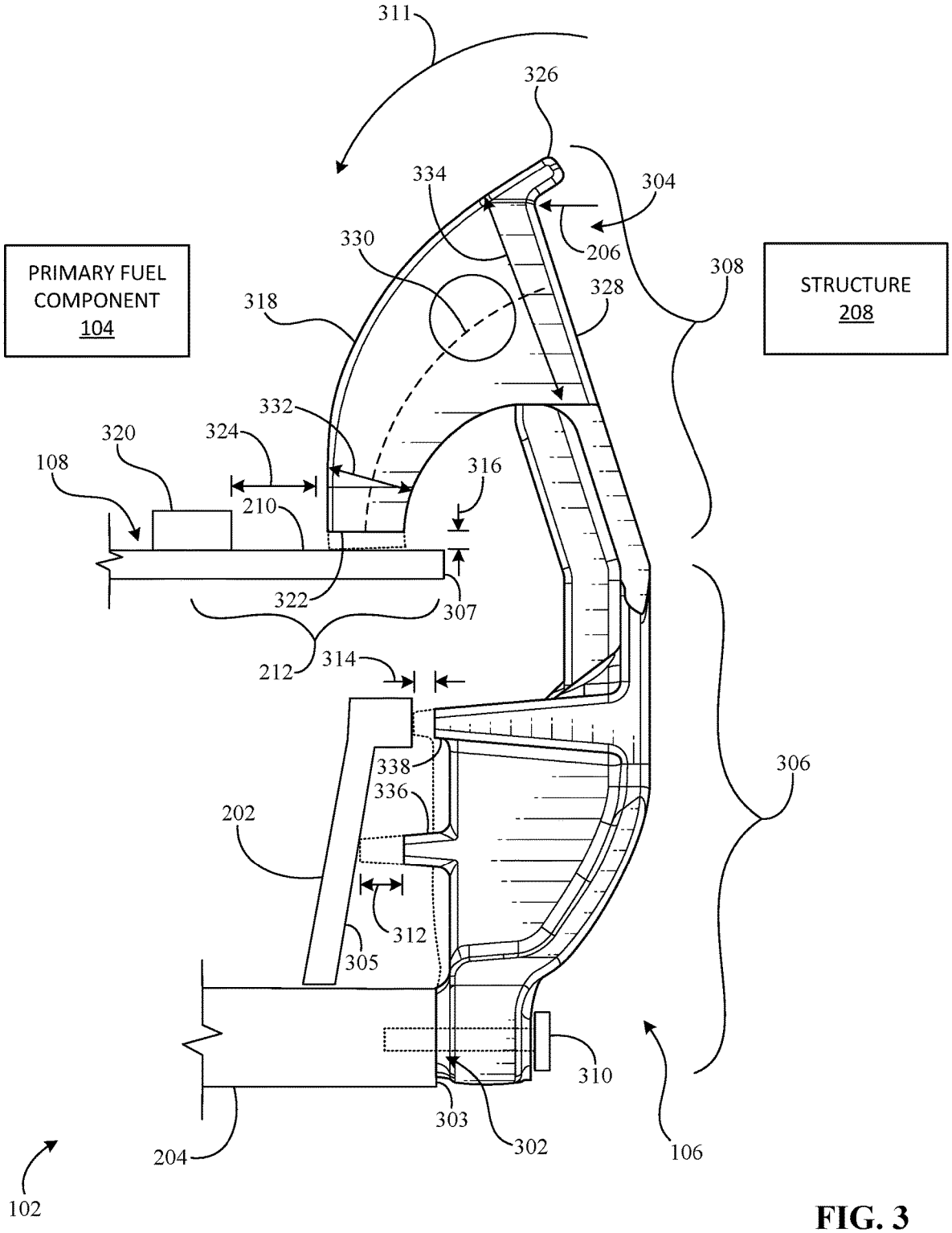
FIGS. 3-5 are views of an example fuel protection assembly and show implementations thereof in accordance with the teachings of this disclosure.

FIG. 3 is a view of the fuel protection assembly 102 and shows another implementation thereof in accordance with the teachings of this disclosure. According to the illustrated example of FIG. 3, the protector 106 is positioned at an attachment point 302 on the second engine component 204. The attachment point 302 can corresponds to a side 303 of the second engine component 204. As such, in some examples, the protector 106 is arranged on the side 303 of the second engine component 204. Further, the protector 106 of FIG. 3 extends away from the attachment point 302 on the second engine component 204 alongside the first engine component 202 and the spacer 108. For example, the first engine component 202 includes a side 305 along which the protector 106 can extend, and the spacer 108 includes a side 307 along which the protector 106 can extend. Additionally, the protector 106 of FIG. 3 includes an impact area 304 to which the primary load 206 can be applied during the vehicle impact event. As shown in FIG. 3, the impact area 304 can face the structure 208. Further, the protector 106 of FIG. 3 is interposed between the primary fuel component 104 and the vehicle structure 208, which allows the protector to shield the primary fuel component 104 from the vehicle structure 208.

In some examples, the protector 106 is changeable between (a) a first state (e.g., an undeformed state) in which the protector 106 is spaced from the second engine component 204 and the spacer 108 and (b) a second state (e.g., a deformed state) in which the protector 106 is engaged with (i.e., directly contacting) the second engine component 204 and the spacer 108. According to the illustrated example of FIG. 3, the protector 106 is in the first state. The second state of the protector 106 of FIG. 3 is generally represented by the dotted/dashed lines of FIG. 3. In such examples, in response to the vehicle structure 208 applying the primary load 206 to the protector 106 during the vehicle impact event, the protector 106 of FIG. 3 is configured to change from the first state to the second state to reduce a portion of the primary load 206 transferred to the primary fuel component 104. That is, the protector 106 of FIG. 3 is configured to substantially deform (e.g., plastically) relative to the attachment point 302 if the primary load 206 applied to the protector 106 is above a threshold load (e.g., a value corresponding to a load that is associated with causing plastic deformation to occur).

The protector 106 of FIG. 3 can be implemented, for example, using a single-piece component. In some examples, the protector 106 includes a bracket. According to the illustrated example of FIG. 3, the protector 106 includes a first protector portion 306 and a second protector portion 308 different relative to the first protector portion 306. In such examples, the first protector portion 306 is positioned on the second engine component 204 at the attachment point 302. In particular, the first protector portion 306 of FIG. 3 is coupled to the second engine component 204, for example, via one or more fasteners and/or one or more fastening methods or techniques. As shown in FIG. 3, at least a first fastener (e.g., a bolt, a stud, a screw, etc.) 310 extends through the first protector portion 306 and the second engine component 204, thereby coupling the first protector portion 306 to the second engine component 204. Further, in such examples, the second protector portion 308 is coupled to the first protector portion 306, for example, via one or more fasteners and/or one or more fastening methods or techniques. In particular, the second protector portion 308 of FIG. 3 is configured to receive the structure 208 and deform relative to the first protector portion 306 to partially absorb the primary load 206. Accordingly, the protector 106 of FIG. 3 can experience (e.g., temporarily) a bending moment 311 resulting from such an impact with the structure 208, which causes the protector 106 to bend. The bending moment 311 can be based on a magnitude of the primary load 206, a direction of the primary load 206, and/or a location on the second protector portion 308 to which the primary load 206 is applied. As the second portion 308 begins to deform relative to the first protector portion 306 (i.e., as the protector 106 begins to bend), the second protector portion 308 moves toward the spacer 108.

The first protector portion 306 can be integral with the second protector portion 308. For example, the first and second protector portions 306, 308 of FIG. 3 form and/or define a single-piece component, as shown in FIG. 3. Alternatively, the first and second protector portions 306, 308 of FIG. 3 can be separate components configured to couple together. In any case, the first protector portion 306, the second protector portion 308, and/or, more generally, the protector 106 of FIG. 3 can be constructed of one or more materials having suitable material properties such as, for example, any of steel, aluminum, cast iron, etc., any other suitable material(s), or a combination thereof. The first protector portion 306 is sometimes referred to as a first portion of the protector 106, and the second protector portion 308 is sometimes referred to as a second portion of the protector 106.

As previously mentioned, the protector 106 is spaced from the spacer 108 and the first engine component 202. According to the illustrated example of FIG. 3, the protector 106 and the first engine component 202 form a first gap (e.g., a relatively small gap) 312. Additionally or alternatively, in some examples, the protector 106 and the first engine component 202 form a second gap (e.g., a relatively small gap) 314. Additionally or alternatively, in some examples, the protector 106 and the spacer 108 form a third gap (e.g., a relatively small gap) 316. As such, one or more (e.g., all) of the gaps 312, 314, 316 exist when the protector 106 is in the first state. In particular, the structure 208 urges the protector 106 or at least a portion 306, 308 thereof to move relative to the attachment point 302 on the second engine component 204 toward the first engine component 202 and the spacer 108 to close one or more (e.g., all) of the first gap 312, the second gap 314, and/or the third gap 316. For example, none of the gaps 312, 314, 316 exist when the protector 106 is in the second state. In some examples, the protector 106 is sized, shaped, structured, and/or otherwise configured to sequentially close, in any sequence, the first gap 312, the second gap 314, and the third gap 316 as the primary load 206 causes the protector 106 to change from the first state to the second state. For example, during the vehicle impact event, the first gap 312 closes, then the second gap 314 closes, and then the third gap 316 closes. On the other hand, in such examples, the gaps 312, 314, 316 of FIG. 3 can sequentially close in any other suitable sequence. Alternatively, in some examples, at least some or all of the gaps 312, 314, 316 close simultaneously.

Depending on load capacities of the first engine component 202, the second engine component 204, and/or the spacer 108, each of the gaps 312, 314, 316 of FIG. 3 can be predetermined or predefined to provide a desired sequence, for example, by particularly sizing and/or shaping one or more surfaces of interest 606, 608, 610, 612, 614 (shown in FIG. 6) of the protector 106. In some examples, each of the gaps 312, 314, 316 has a unique size. However, in some examples, at least some or all of the gaps 312, 314, 316 are sized the same.

In some examples, the second protector portion 308 includes a first arm 318, which facilitates transferring a portion of the primary load 206 to the spacer 108. As shown in FIG. 3, the first arm 318 can be positioned adjacent the impact area 304. In some examples, the impact area 304 is at least partially formed by the first arm 318. The first arm 318 of FIG. 3 extends away from the impact area 304 toward the spacer 108. Additionally, the first arm 318 of FIG. 3 is spaced from the receiving portion 212 of the body 210, which provides the third gap 316. That is, the third gap 316 can exist between the first arm 318 and the receiving portion 212. In particular, as the second protector portion 308 begins to deform relative to the first protector portion 306, the first arm 318 is configured to first move toward to the spacer 108, which closes the third gap 316. Then, the first arm 318 is configured to slide against the spacer 108 to limit bending of the protector 106.

In some examples, the receiving portion 212 of the body 210 abuts the first arm 318 as the first arm 318 travels along an outer surface of the spacer 108 that is defined by the receiving portion 212 of the body 210. In such examples, the receiving portion 212 applies a load (e.g., vertical load) to the first arm 318. In this manner, the spacer 108 counteracts the bending moment 311 associated with the protector 106. Such engagement between the first arm 318 and the spacer 108 can also partially transfer the primary load 206 to the spacer 108, for example, prior to the first arm 318 engaging a stopping feature of the spacer 108.

In some examples, to limit relative movement of the second protector portion 308 toward the primary fuel component 104, the spacer 108 includes a first stopper 320. The first stopper 320 of FIG. 3 is coupled to the body 210 of the spacer 108 on or adjacent to the receiving portion 212 of the body 210. The first stopper 320 of FIG. 3 is spaced from a first end 322 of the first arm 318. As shown in FIG. 3, the first stopper 320 and the first end 322 of the first arm 318 form a fourth gap 324, which can be closed by the protector 106 during the vehicle impact event. In particular, in such examples, the first stopper 320 is configured to engage the first end 322 of the first arm 318 to partially absorb the primary load 206, for example, when the protector 106 is in the second state. In some examples, after the first end 322 of the first arm 318 lands on the spacer 108, the first end 322 of the first arm 318 moves toward the first stopper 320 as the structure 208 continues to apply the primary load 206 to the protector 106. Then, the first arm 318 or the first end 322 thereof is configured to engage the first stopper 320 to partially transfer the primary load 206 to the spacer 108. In such examples, the first arm 318 or the first end 322 thereof applies a compressive load to the spacer 108, which reduces or eliminates risks typically associated with a tensile load being applied to the spacer 108.

In some examples, to maintain a connection between the protector 106 and structure 208 during the vehicle impact event, the second protector portion 308 includes a hook feature 326. The hook feature 326 of FIG. 3 can include, for example, a protrusion that can form a hook-shape. The hook feature 326 of FIG. 3 is positioned adjacent the impact area 304 and a second end 328 of the first arm 318. In some examples, the hook feature 326 is coupled to part of the second protector portion 308 such as, for example, the second end 328 of the first arm 318. The second end 328 of the first arm 318 is opposite relative to the first end 322 of the first arm 318. As shown in FIG. 3, the hook feature 326 can extend away from the impact area 304 and/or the second end 328 of the first arm 318. In particular, the hook feature 326 is sized, shaped, structured, and/or otherwise configured to catch the structure 208 when the structure 208 moves toward the protector 106. That is, the hook feature 326 of FIG. 3 can lock onto the structure 208, which prevents the structure 208 from moving past the protector 106 and contacting the primary fuel component 104. Although FIG. 3 depicts a protrusion, in some examples, the hook feature 326 of FIG. 3 is implemented differently while still sufficiently maintaining such functionality. For example, the hook feature 326 can include one or more recesses (e.g., grooves or slots) of different shapes and/or sizes on the entire length of the hook feature 326 or at least part of the length. Further, the hook feature 326 can be positioned and/or oriented on the protector 106 in a location other than the second end 328 of the first arm 318.

As shown in FIG. 3, the first arm 318 can curve away from the hook feature 326 toward the spacer 108. In some examples, the first arm 318 extends along a substantially curved path (e.g., a semi-circular or arc-shaped path) 330 from the first end 322 of the first arm 318 to the second end 328 of the first arm 318 opposite the first end 322. According to the illustrated example of FIG. 3, the first arm 318 has a length that is defined between the first end 322 of the first arm 318 and the second end 328 of the first arm 318. In some examples, the first arm 318 is tapered along the length. For example, the first end 322 of the first arm 318 has a first width or thickness 332, and the second end 328 of the first arm 318 has a second width or thickness 334 different (e.g., greater) than the first thickness 332. As shown in FIG. 3, the second end 328 of the first arm 318 is substantially wider or thicker than the first end 322 of the first arm 318.

Although FIG. 3 depicts the first arm 318, in some examples, the protector 106 of FIG. 3 is implemented differently. In such examples, the protector 106 can be implemented using one or more other arms in addition or alternatively to the first arm 318, as discussed further below in connection with FIGS. 4-6. Accordingly, although FIG. 3 depicts aspects in connection with the first arm 318, in some examples, such aspects likewise apply to the other arm(s) of the protector 106.

Additionally, in some examples, the first protector portion 306 includes a first rib 336, which facilitates transferring a portion of the primary load 206 to the first engine component 202. The first rib 336 of FIG. 3 is spaced from the first engine component 202, which provides the first gap 312. As shown in FIG. 3, the first gap 312 can exist between first rib 336 and the side 305 of the first engine component 202. Further, the first rib 336 of FIG. 3 extends alongside the first engine component 202. In particular, as a result of the protector 106 changing from the first state to the second state, the first rib 336 is configured to engage the first engine component 202 to partially transfer the primary load 206 to the first engine component 202. Additionally or alternatively, in some examples, the first protector portion 306 includes a second rib (e.g., similar to the first rib 336) 338. The second rib 338 of FIG. 3 is spaced from the first engine component 202, which provides the second gap 314. As shown in FIG. 3, the second gap 314 can exist between second rib 338 and the side 305 of the first engine component 202. Further, second rib 338 of FIG. 3 can extend alongside the first engine component 202. In particular, as a result of the protector 106 changing from the first state to the second state, the second rib 338 is configured to engage the first engine component 202 to partially transfer the primary load 206 to the first engine component 202.

Thus, in some examples, the protector 106 of FIG. 3 is implemented using a single rib 336, 338 or multiple (i.e., two or more) ribs 336, 338, each of which can be positioned on first protector portion 306. As shown in FIG. 3, the first rib 336 and the second rib 338 are separate from each other.

Figure 4:
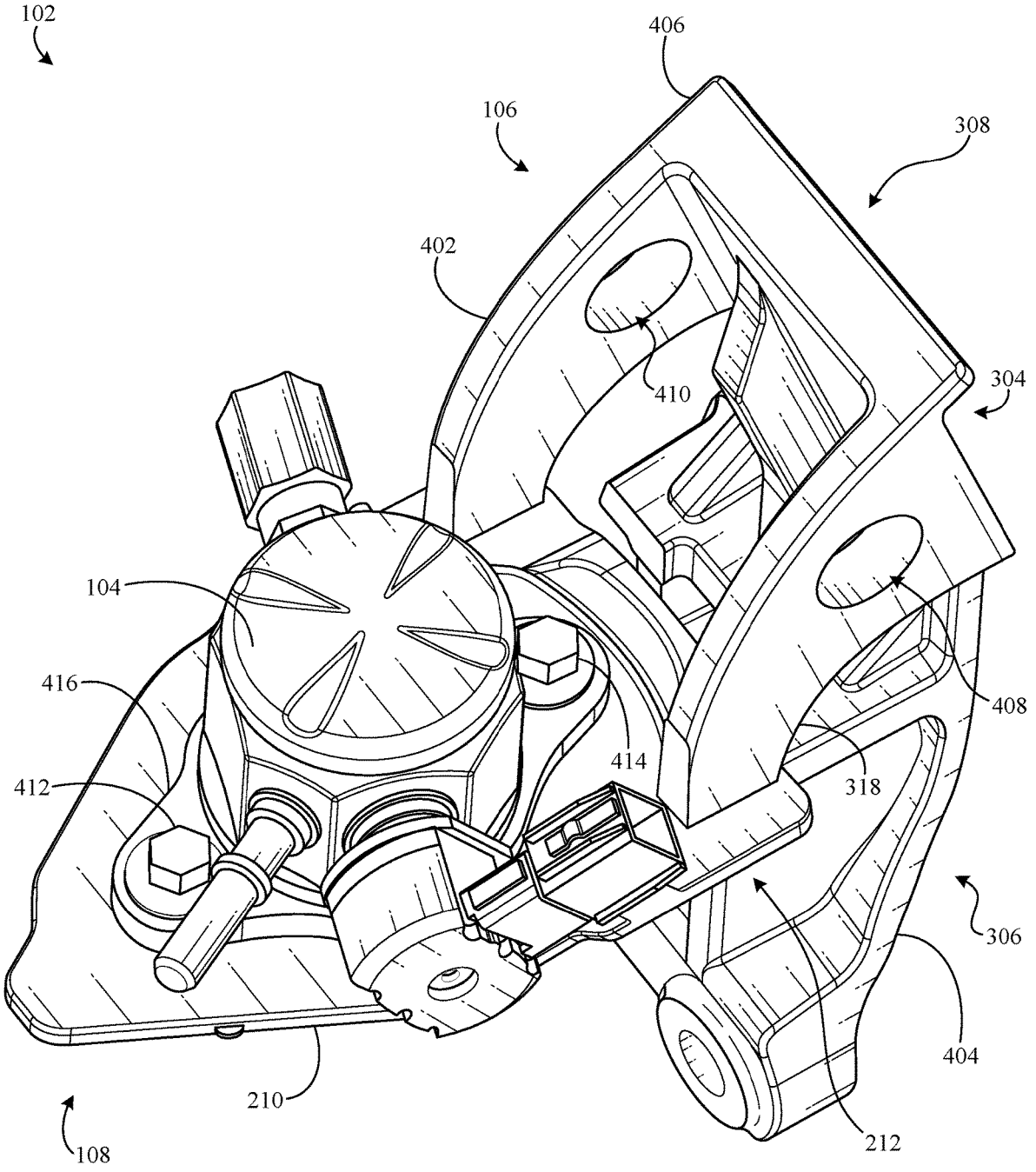

FIG. 4 is a view of the fuel protection assembly 102 as shows another implementation thereof in accordance with the teachings of this disclosure. According to the illustrated example of FIG. 4, the primary fuel component 104, the spacer 108, and the protector 106 have been removed from the engine components 202, 204, for clarity. In some examples, the second protector portion 308 includes a second arm (e.g., similar to the first arm 318) 402, as shown in FIG. 4. The second arm 402 of FIG. 4 is separate from the first arm 318. The second arm 402 of FIG. 4 extends away from the impact area 304 toward the spacer 108. The second arm 402 of FIG. 4 is spaced from the receiving portion 212 of the body 210, which provides a gap (e.g., similar to the third gap 316) between the second arm 402 and the receiving portion 212. In particular, in such examples, during the vehicle impact event, the second arm 318 is configured to slide against the spacer 108 to further limit bending of the protector 106. For example, the receiving portion 212 of the body 210 can abut the second arm 402 as the second arm 402 travels along the outer surface of the spacer 108 that is defined by the receiving portion 212 of the body 210.

In some examples, the second arm 402 of FIG. 4 is positioned on the second protector portion 308 opposite relative to the first arm 318. For example, the first arm 318 of FIG. 4 is positioned at or adjacent a first side 404 of the protector 106, and the second arm 402 of FIG. 4 is positioned at or adjacent a second side 406 of the protector 106 opposite the first side 404. In such examples, each of the first and second arms 318, 402 can be provided with a respective opening (e.g., circular hole) 408, 410.

The spacer 108 of FIG. 4 can be coupled to the primary fuel component 104, for example, via one or more fasteners 412, 414 and/or one or more fastening methods or techniques. Two of the fasteners 412, 414 are shown in the illustrated example of FIG. 4 (i.e., a second fastener 412 and a third fastener 414). Each of the fasteners 412, 414 of FIG. 4 can extend through the body 210 of the spacer 108 and a flange 416 of the primary fuel component 104. Further, as shown in FIG. 3, the body 210 of the spacer 108 extends beneath the flange 416 of the primary fuel component 104.

Figure 5:
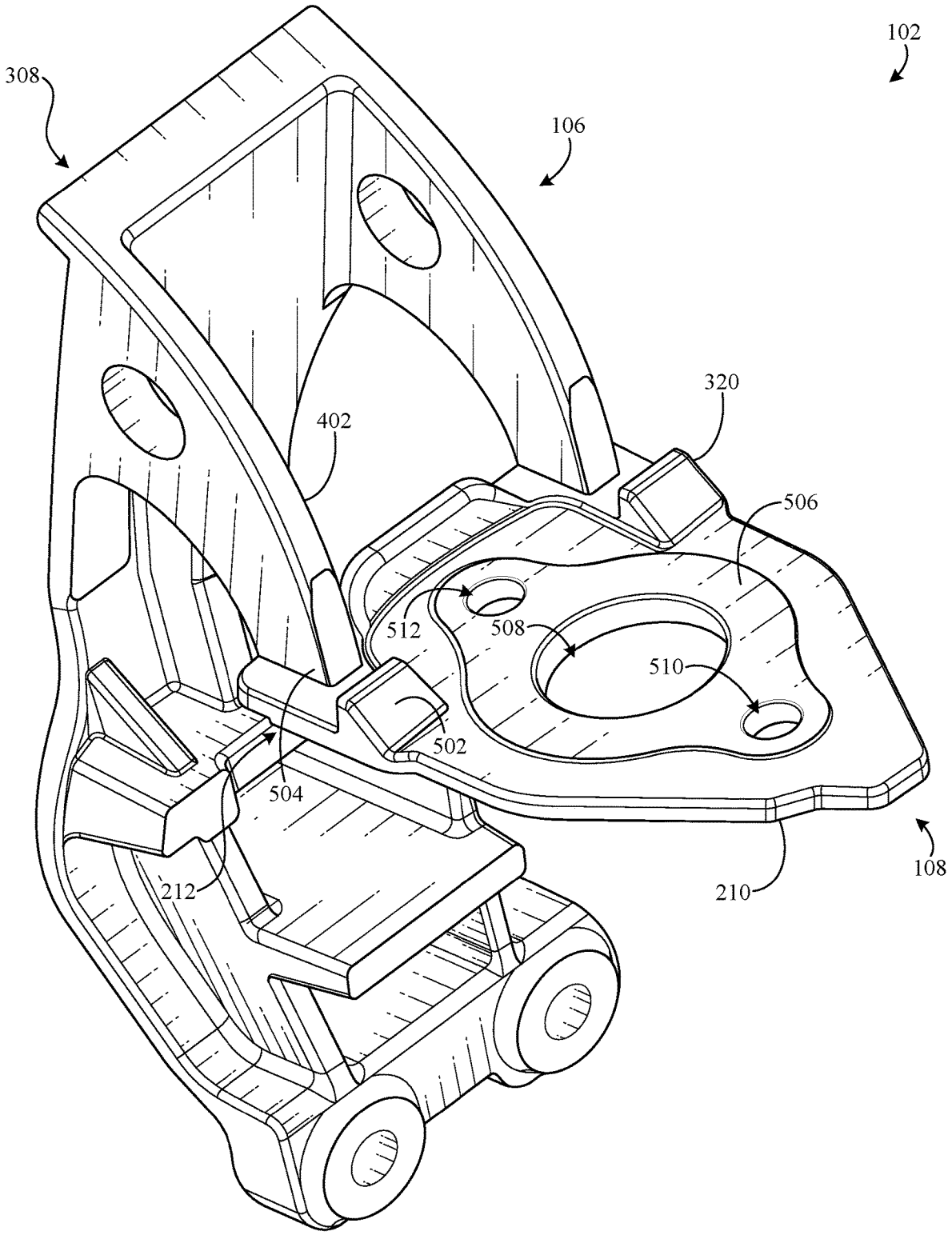

FIG. 5 is another view of the fuel protection assembly 102 as shows another implementation thereof in accordance with the teachings of this disclosure. According to the illustrated example of FIG. 5, the primary fuel component 104 has been removed from the spacer 108, for clarity. In some examples (e.g., where the protector 106 or the second portion 308 thereof is implemented using multiple arms), the spacer 108 includes a second stopper 502, which further limits relative movement of the second protector portion 308 toward the primary fuel component 104. The second stopper 502 of FIG. 5 is coupled to the body 210 of the spacer 108 on or adjacent to the receiving portion 212 of the body 210. The second stopper 502 of FIG. 5 is spaced from an end 504 of the second arm 402, which provides a gap (e.g., similar to the fourth gap 324) between second stopper 502 and the end 504 of the second arm 402. The second stopper 502 of FIG. 5 is separate from the first stopper 320. For example, the first stopper 320 is positioned on the body 210 of the spacer 108 opposite relative to the second stopper 502. In particular, in such examples, the second stopper 502 is configured to engage the end 504 of the second arm 402 to partially absorb the primary load 206, for example, when the protector 106 is in the second state.

In some examples, the spacer 108 includes a central surface (e.g., a machined surface that is substantially smooth) 506 that is centrally positioned on the body 210, which facilitates mounting the primary fuel component 104 on the body 210 during assembly. As such, the central surface 506 of FIG. 5 is configured to directly contact a portion of the primary fuel component 104 such as, for example, the flange 416. That is, the flange 416 is positionable on the central surface 506. Further, in some examples, the spacer 108 also includes a primary opening 508. The primary opening 508 extends through the central surface 506 of the spacer 108. In particular, the primary opening 508 can receive a component (e.g., a plunger) of the primary fuel component 104.

Further still, in some examples, the spacer 108 also includes one or more auxiliary openings 510, 512, two of which are shown in this example (i.e., a first auxiliary opening 510 and a second auxiliary opening 512). The auxiliary openings 510, 512 extend through the central surface 506. In particular, each of the auxiliary openings 510, 512 can receive a fastener for coupling the spacer 108 to the primary fuel component 104 such as, for example, one of the fasteners 412, 414 of FIG. 4.

Figure 6:
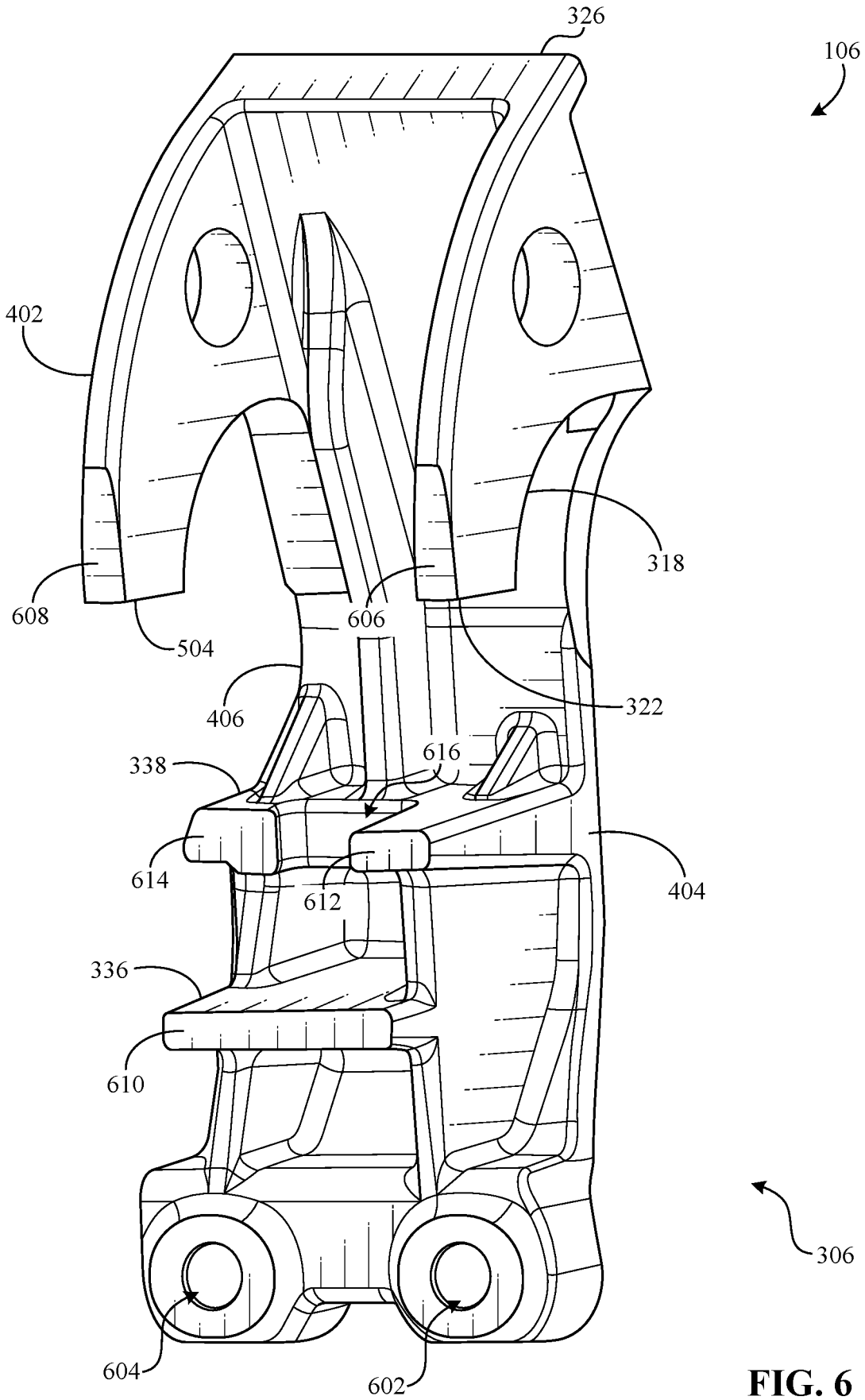
FIG. 6 is a view of an example protector and shows an implementation thereof in accordance with the teachings of this disclosure.

FIG. 6 is a view of the protector 106 and shows an implementation thereof in accordance with the teachings of this disclosure. According to the illustrated example of FIG. 6, the first protector portion 306 includes one or more openings (e.g., circular openings) 602, 604, which facilitate connecting the protector 106 to the second engine component 204 at the attachment point 302. Two of the openings 602, 604 are shown in the illustrated example of FIG. 6. Each of the openings 602, 604 of FIG. 6 extends through the second protector portion 306. In particular, each of the openings 602, 604 is sized and/or shaped to receive a fastener (e.g., the first fastener 310) for coupling the first protector portion 306 to the second engine component 204.

Additionally, in some examples, the protector 106 includes one or more smooth or flat surfaces (e.g., machined surfaces), which facilitate providing desired sizes of respective ones of the gaps 312, 314, 316 associated with the protector 106. For example, the protector 106 of FIG. 6 includes a first flat surface (e.g., a machined surface) 606 formed on the first end 322 of the first arm 318, which can face the first stopper 320. Additionally or alternatively, the protector 106 of FIG. 6 includes second flat surface (e.g., a machined surface) 608 formed on the end 504 of the second arm 402, which can face the second stopper 502.

Further, in some examples, the protector 106 includes a third flat surface (e.g., a machined surface) 610 formed on the first rib 336, which can face the side 305 of the first engine component 202. Additionally or alternatively, in some examples, the protector 106 includes a fourth flat surface (e.g., a machined surface) 612 and a fifth flat surface (e.g., a machined surface) 614 that are formed on the second rib 338, each of which can face the side 305 of the first engine component 202. In such examples, the fourth flat surface 612 is separate from the fifth flat surface 614. As shown in FIG. 6, the second protector portion 306 can include a recess 616 positioned on the second rib 338. The recess 616 of FIG. 6 extends at least partially into the second rib 338, which separates the fourth flat surface 612 from the fifth flat surface 614. One or more (e.g., all) of flat surface(s) 606, 608, 610, 612, 614 of FIG. 6 can be produced, for example, via one or more machining methods or techniques.

The hook feature 326 of FIG. 6 is positioned on a topmost (in the orientation of FIG. 6) portion of the protector 106. As shown in FIG. 6, the hook feature 326 can extend between the first side 404 of the protector 106 and the second side 406 of the protector 106, for example, from the first arm 318 to the second 402. Further, each of the first and second ribs 336, 338 can extend between the first side 404 of the protector 106 and the second side 406 of the protector 106.

Figure 7:
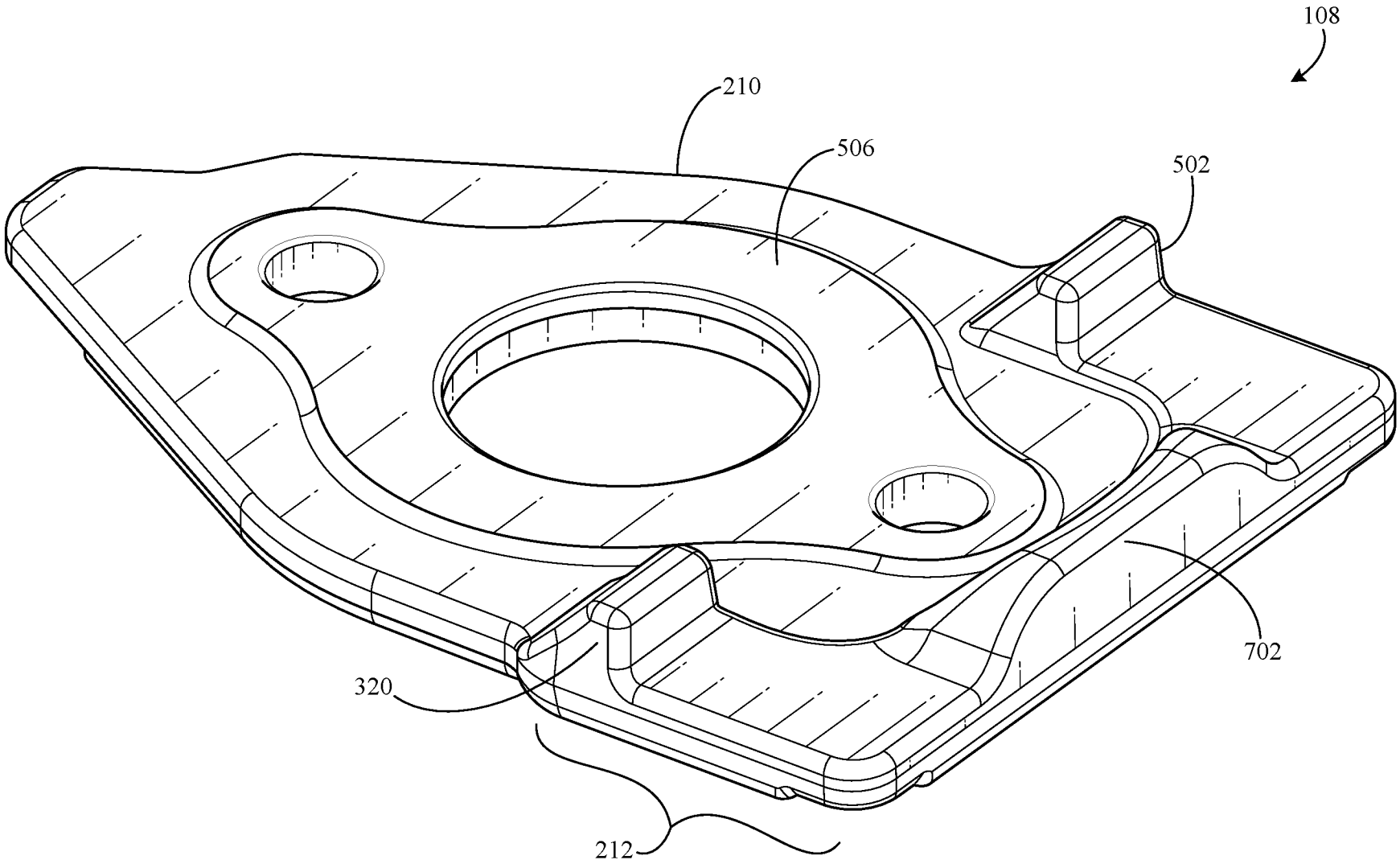
FIG. 7 is a view of an example spacer and shows an implementation thereof in accordance with the teachings of this disclosure.

FIG. 7 is a view of the spacer 108 and shows an implementation thereof in accordance with the teachings of this disclosure. According to the illustrated example of FIG. 7, the spacer 108 includes the first stopper 320 and the second stopper 502. In some examples, the spacer 108, the first stopper 320, and the second stopper 502 form and/or define a single-piece component. For example, each of the spacer 108, the first stopper 320, and the second stopper 502 share a cross-sectional area (i.e., the same cross-sectional area). As shown in FIG. 7, each of the first stopper 320 and the second stopper 502 can project from the central surface 506 of the spacer 108. Further, each stopper 320, 502 has a shape that can be, for example, substantially triangular. Additionally, in some examples, the spacer 108 includes a strengthening member 702, which increases strength and/or rigidity of the spacer 108. The strengthening member 702 is formed on the receiving portion 212 of the body 210. In such examples, when the protector 106 and the spacer 108 are assembled, the strengthening member 702 of FIG. 7 is interposed between the first arm 318 and the second arm 402.

As used herein, the terms "including" and "comprising" (and all forms and tenses thereof) are to be open ended terms. Thus, whenever a claim employs any form of "include" or "comprise" (e.g., comprises, includes, comprising, including, has, having, etc.) as a preamble or within a claim recitation of any kind, it is to be understood that additional elements, terms, etc. may be present without falling outside the scope of the corresponding claim or recitation. As used herein, when the phrase "at least" is used as the transition term in, for example, a preamble of a claim, it is open-ended.

It will be appreciated that the apparatus, systems, and methods disclosed in the foregoing description provide numerous advantages. Examples disclosed herein provide a compact, cost-effective solution to protect to one or more fuel components of a vehicle during a certain vehicle impact event. Disclosed examples improve vehicle safety while substantially reducing vehicle weight typically associated with fuel protection components.

Although certain example apparatus, systems, and methods have been disclosed herein, the scope of coverage of this patent is not limited thereto. Obviously, numerous modifications and variations are possible in light of the above teachings. It is therefore to be understood that within the scope of the appended claims, the invention may be practiced otherwise than as specifically described herein.

Thus, the foregoing discussion discloses and describes merely exemplary embodiments of the present invention. As will be understood by those skilled in the art, the present invention may be embodied in other specific forms without departing from the spirit or essential characteristics thereof. Accordingly, the disclosure of the present invention is intended to be illustrative, but not limiting of the scope of the invention, as well as other claims. The disclosure, including any readily discernible variants of the teachings herein, defines, in part, the scope of the foregoing claim terminology such that no inventive subject matter is dedicated to the public.

What is claimed is:

1. A vehicle, comprising:

a fuel component in an engine compartment of the vehicle;

a spacer coupled to a cam carrier and positioned proximate to the fuel component; and a protector coupled to a cylinder head and spaced apart from the spacer and the cam carrier so as not to be in contact therewith, the protector configured to receive a load from a cowl brace or firewall of the vehicle during a vehicle impact event in which an engine assembly of the vehicle moves relative to the cowl brace or firewall, wherein the protector is configured to transfer the load to the cylinder head, the cam carrier, and the spacer to protect the fuel component.

2. The vehicle of claim 1, wherein the protector extends away from an attachment point on the cylinder head alongside the cam carrier and the spacer.

3. The vehicle of claim 2, wherein:

the protector and the cam carrier form a first gap and a second gap, the protector and the spacer form a third gap, and the cowl brace or firewall urges at least a portion of the protector to move relative to the attachment point on the cylinder head toward the cam carrier and the spacer to close the first gap, the second gap, and the third gap.

4. The vehicle of claim 3, wherein the protector is configured to sequentially close, in any sequence, the first gap, the second gap, and the third gap.

5. The vehicle of claim 1, wherein the fuel component includes a fuel pump.

6. The vehicle of claim 5, wherein the spacer includes a plate coupled between the fuel pump and the cam carrier.

7. The vehicle of claim 1, wherein the protector includes a first protector portion positioned on the cylinder head and a second protector portion coupled to the first protector portion, the second protector portion configured to receive the cowl brace or firewall and deform relative to the first protector portion to partially absorb the load.

8. The vehicle of claim 7, wherein the second protector portion includes an impact area and a first arm extending away from the impact area toward the spacer, the first arm configured to slide against the spacer to limit bending of the protector.

9. The vehicle of claim 8, wherein the spacer includes a stopper spaced from an end of the first arm and configured to engage the end of the first arm to partially absorb the load.

10. The vehicle of claim 8, wherein the second protector portion includes a hook feature that is positioned adjacent an end of the first arm and configured to catch the cowl brace or firewall when the cowl brace or firewall moves toward the protector.

11. The vehicle of claim 10, wherein the first arm curves away from the hook feature toward the spacer.

12. The vehicle of claim 8, wherein the second protector portion includes a second arm separate from the first arm and extending away from the impact area toward the spacer, the second arm configured to slide against the spacer to further limit bending of the protector.

13. The vehicle of claim 7, wherein the first protector portion includes a first rib spaced from the cam carrier and extending alongside the cam carrier, the first rib configured to engage the cam carrier to partially transfer the load to the cam carrier.

14. The vehicle of claim 13, wherein the first protector portion includes a second rib spaced from the cam carrier and extending alongside the cam carrier, the second rib separate from the first rib and configured to engage the cam carrier to partially transfer the load to the cam carrier.

15. A fuel protection assembly for a vehicle, comprising:

a spacer coupled to a first engine component of the vehicle and positioned proximate to a fuel component of the vehicle; and a protector coupled to a second engine component of the vehicle and spaced apart from the spacer and the first engine component so as not to be in contact therewith, the protector configured to receive a load from a vehicle structure in an engine compartment of the vehicle during a vehicle impact event, wherein the protector is configured to transfer the load to the first engine component, the second engine component, and the spacer to protect the fuel component.

16. The fuel protection assembly of claim 15, wherein the protector includes a first protector portion positioned on the second engine component and a second protector portion coupled to the first protector portion, the second protector portion configured to receive the vehicle structure and deform relative to the first protector portion to partially absorb the load.

17. The fuel protection assembly of claim 16, wherein the second protector portion includes an impact area and an arm extending away from the impact area toward the spacer, the arm configured to slide against the spacer to limit bending of the second protector portion.

18. The fuel protection assembly of claim 17, wherein the arm is configured to engage a stopper positioned on the spacer to partially transfer the load to the spacer.

19. The fuel protection assembly of claim 18, wherein the second protector portion includes a hook feature that is adjacent an end of the arm and extending away from the end, the hook feature configured to catch the vehicle structure when the vehicle structure moves toward the protector.

20. An apparatus, comprising:

a protector in an engine compartment of a vehicle, the protector coupled to a first engine component and interposed between a fuel component and a vehicle structure, the protector extending alongside a second engine component and a spacer so as not to be in contact therewith that is proximate to the fuel component, the protector being changeable between (a) a first state in which the protector is spaced from the second engine component and the spacer and (b) a second state in which the protector is engaged with the second engine component and the spacer, wherein, in response to the vehicle structure applying a load to the protector during a vehicle impact event, the protector is configured to change from the first state to the second state to reduce a portion of the load transferred to the fuel component.

* * * * *